United States Patent [19]

Fehric

[11] 4,201,254

[45] May 6, 1980

[54] MULTIPLE PURPOSE WOODWORKING STRUCTURE

[76] Inventor: Mustafa Fehric, c/o Douglas S. Johnson, 133 Richmond St. West, Toronto, Ontario, Canada, M5H 2L7

[21] Appl. No.: 914,039

[22] Filed: Jun. 9, 1978

[51] Int. Cl.[2] ..... B27C 9/00

[52] U.S. Cl. ..... 144/1 G; 51/135 R; 51/166 MH; 83/477.2; 144/1 R; 248/662

[58] Field of Search ..... 144/1 R, 1 C, 1 G, 35 R, 144/35 A, 92, 134 R, 136 R, 321, 323, 326 R, 1 H, 325; 51/166 MH, 135 R; 74/242.13 R, 242.15 R; 83/477.2; 248/23, 662

[56] References Cited

U.S. PATENT DOCUMENTS

| | | | |
|---|---|---|---|
| 1,608,037 | 11/1926 | Rochon | 144/1 C |
| 2,501,134 | 3/1950 | Meckoski et al. | 144/134 R X |
| 2,577,206 | 12/1951 | Patterson | 144/134 R X |
| 3,352,334 | 11/1967 | Hunn | 144/1 R X |
| 3,368,596 | 2/1968 | Comer | 144/1 R |
| 3,771,579 | 11/1973 | Heuze | 144/1 C |

*Primary Examiner*—R. L. Spruill
*Assistant Examiner*—W. D. Bray

[57] ABSTRACT

The specification describes a multiple purpose woodworking structure including a working surface having a single work area for performing a plurality of operations. A motor rotatable from a locked horizontal position to a locked vertical position is located below the working surface. The motor is mounted on bearing means such that it is slidable within the structure to maintain the motor head below the single working area when it is moved from the horizontal to the vertical position, thereby minimizing the space requirements of the structure.

5 Claims, 6 Drawing Figures

FIG. 5.
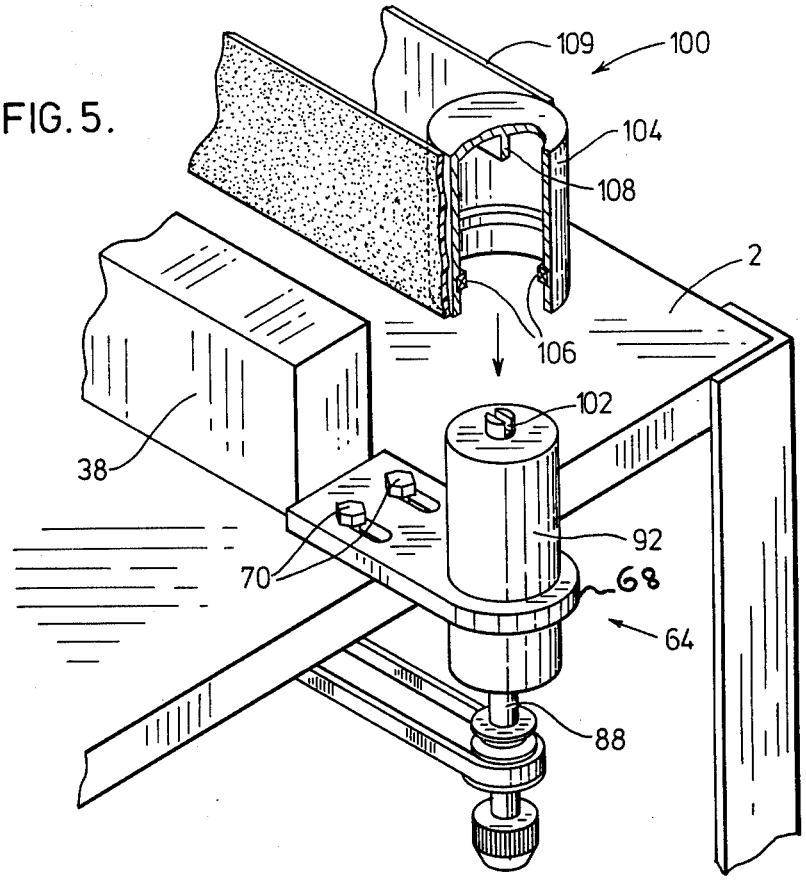
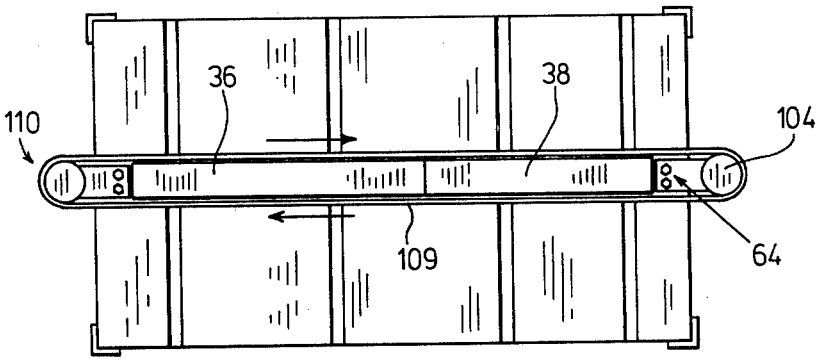
FIG. 6.

MULTIPLE PURPOSE WOODWORKING STRUCTURE

FIELD OF THE INVENTION

The present invention relates to multiple purpose woodworking tables.

BACKGROUND OF THE INVENTION

In the past, multiple purpose woodworking tables have been designed for performing a variety of different woodworking operations on one table. However, such tables have been awkward to work with for one or more reasons. One of the primary reasons is that the prior art tables use separate work areas for each of the woodworking operations, including sawing, planing, shaping, etc. The provision of separate work areas has resulted in overly large structures, which are not satisfactory for some uses and particularly use in the home, where the amount of available space is usually restricted.

One of the most highly desirable features of a multiple purpose woodworking table is the use of a single motor for performing the various woodworking operations. As can be appreciated, if a different motor were required for each operation, such structures would become overly expensive.

In order to assure the performance of certain different operations, the orientation of the output of the single motor must be variable. More specifically, in order to perform a sawing operation, it is generally desirable to have the saw blade rotate about a horizontal axis. On the other hand, in order to perform a shaping operation, it is generally desirable to have the shaper rotate about a vertical axis. In the past, this has necessitated the use of complicated gearing and pulley arrangements and the changing of the orientation of the motor output has again resulted in the movement of the working area requiring the provision of an unduly large working surface.

The present invention overcomes the drawbacks of the prior art and provides an economical efficient multiple purpose woodworking structure. The structure includes a working surface having a single work area for performing a plurality of operations, located below the working surface is a motor rotatable from a locked horizontal position to a locked vertical position. The motor is mounted on bearing means such that it is slidable within the structure to maintain the motor head below the single working area when it is moved from the horizontal to the vertical position, thereby minimizing the space requirements of this structure.

BRIEF DISCUSSION OF THE DRAWINGS

Various preferred embodiments of the present invention are shown in the attached drawings, wherein:

FIG. 5 is an enlarged perspective view looking down on a preferred drive arrangement for operating a sander according to the present invention; and FIG. 6 is a top view looking down on a sanding arrangement according to the present invention.

DETAILED DESCRIPTION OF THE PREFERRED EMBODIMENTS ACCORDING TO THE INVENTION

Figure 1:
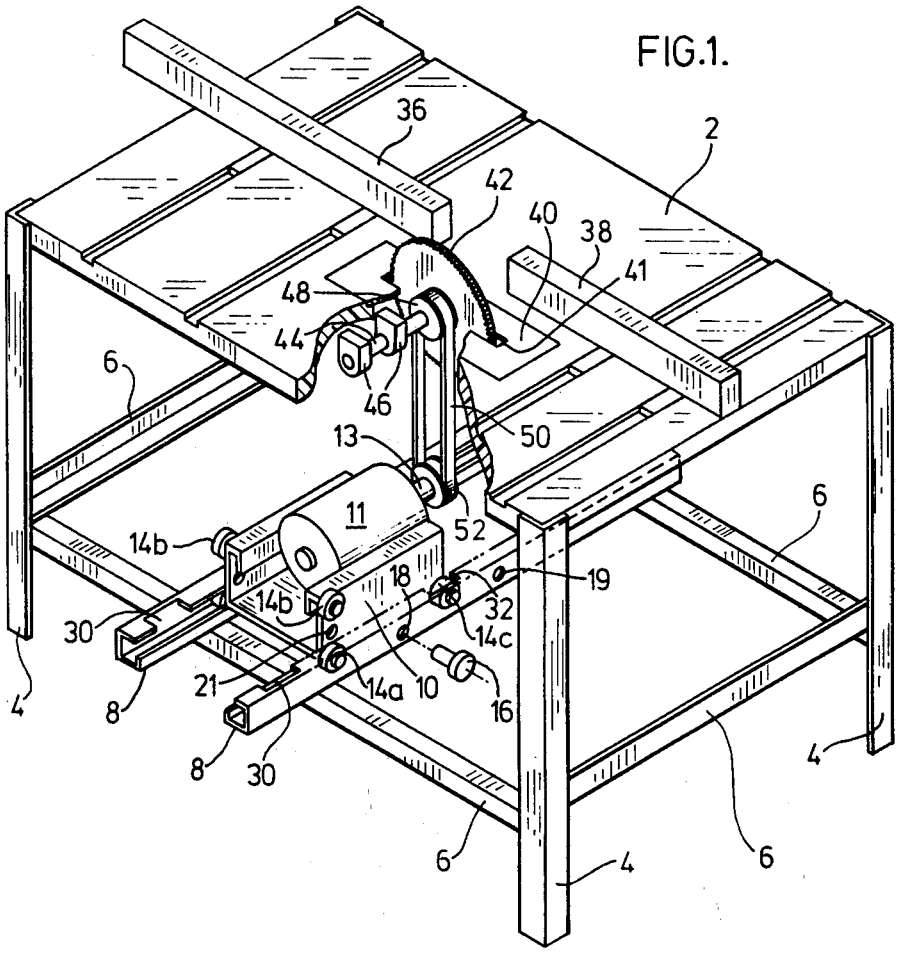
FIG. 1 is a partially cut away perspective view looking down on a preferred arrangement of the woodworking structure of the present invention when used as a table saw.

The woodworking apparatus comprises a horizontal woodworking surface 2, which is supported at its corners by legs 4. Horizontal reinforcing members 6 brace the legs 4 and essentially define a second horizontal tier below the woodworking surface. Two parallel horizontal channel members 8 extend across the width of the table and are secured to opposed bracing members 6. The motor mounting bracket 10 has been provided with three pairs of wheels 14*a*, 14*b*, and 14*c*. The channel members 8 are adapted to releasably engage pairs of wheels 14*b* and 14*c* and to provide a runway for the wheels. Pairs of wheels 14*a* remain in the channel members. As will be more fully described hereinafter this arrangement allows the motor mount bracket 10 to slide beneath the woodworking surface and permits 90° rotation of the motor. In addition, it prevents any tipping movement of the motor when two pairs of wheels are engaged in the channel members.

Working surface 2 has been provided with a central aperture for securing a variety of different plate members, or a single plate member provided with a plurality of different shaped openings. This plate member defines the working area. Plate member 40 is shown in FIG. 1 for accommodating the use of a circular saw in which the circular saw blade 42 extends through elongated slot 41 provided in the plate. As can be appreciated, other plates provided with appropriate openings will be provided for the use of other woodworking tools such as shapers, planers, etc.

When the motor is used with the saw blade, it is lying in the horizontal position with the motor head below the working area. Sets of wheels 14*a* and 14*c* are positioned in the channel members and the motor mount is locked in place by pin 16 extending through locking apertures 18 and 20 provided in the channel member and motor mount respectively. These apertures act as a locating means for proper location of the motor head.

Saw blade 42 is secured to the work surface by pillow blocks 46 and shaft 44. The saw blade which rotates in the same direction as the motor head (i.e., about a horizontal axis) and is connected thereto by pulleys 48 and 52 and drive belt 50. Although only one pulley has been shown, other pulleys of different diameters could be used to increase or decrease the speed of the saw blade.

As shown in FIG. 1, work surface 2 has been further provided with a sliding longitudinally extendable guide 36 adapted to move transversally across the width of the working surface. The sliding guide includes locking means (not shown) for securing it in a desired working position. A second guide 38 has also been provided and is removably secured to the table top.

In order to use the motor with the shaping, planing, sanding, or drill attachment, the motor head must rotate about a vertical axis which requires rotation of the motor to the upright position.

Figure 2:
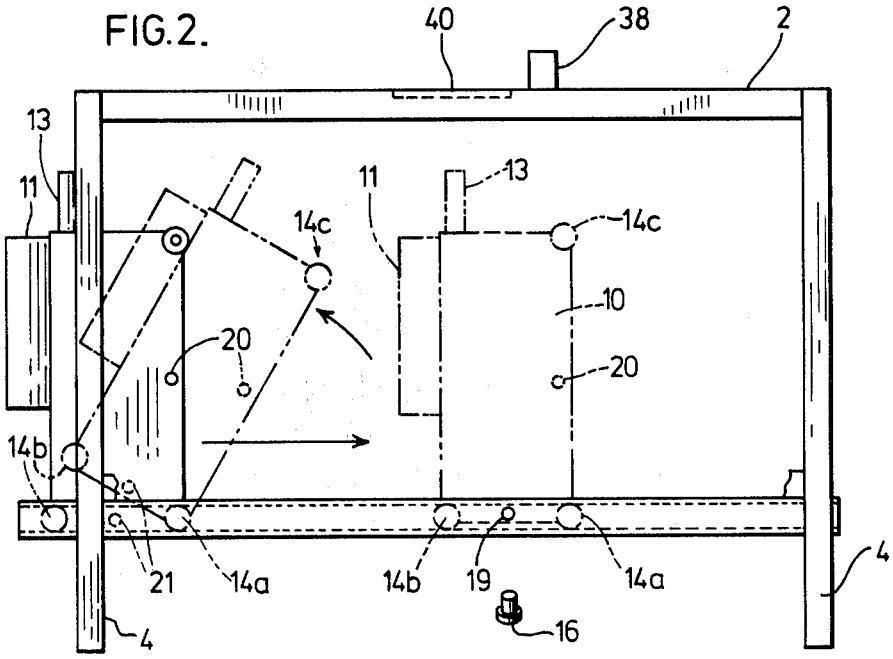
FIG. 2 is an end view showing a preferred motor mounting means according to this invention.

Each of the channel members has been provided with a pair of cut-out portions 30 and 32 permitting the releasing of the pairs of wheels 14*b* and 14*c* respectively. The cut-out portions have been spaced such that pairs of wheels 14*c* are released through portions 32 while pairs of wheels 14*b* enter the channel members through portions 30 with the motor mount and motor rotating about pairs of wheels 14*a*. Pairs of wheels 14*a* being locked in the channel members prevent tipping of the motor and its mount. This aspect is best shown in FIG. 2.

However, as a result of the length to width proportions of the motor and its mount, such rotation of the motor mount moves the motor head from beneath the working area. These proportions are highly desirable for purposes of raising the motor shaft when in the vertical orientation to a position where a shaping or planing attachment can be secured directly thereto, as will be described with reference to FIG. 3.

Therefore, in order to relocate the shaft 13 below the work area, the motor and mount are simply slid on wheels 14*a* and 14*b* in channel members 8 beneath the table top to the appropriate position and then locked in place by pin 16, which is fitted through apertures 21 and 19 provided in the motor mount and channel member respectively, which act as a locating means for positioning the motor shaft below the working area.

Figure 3:
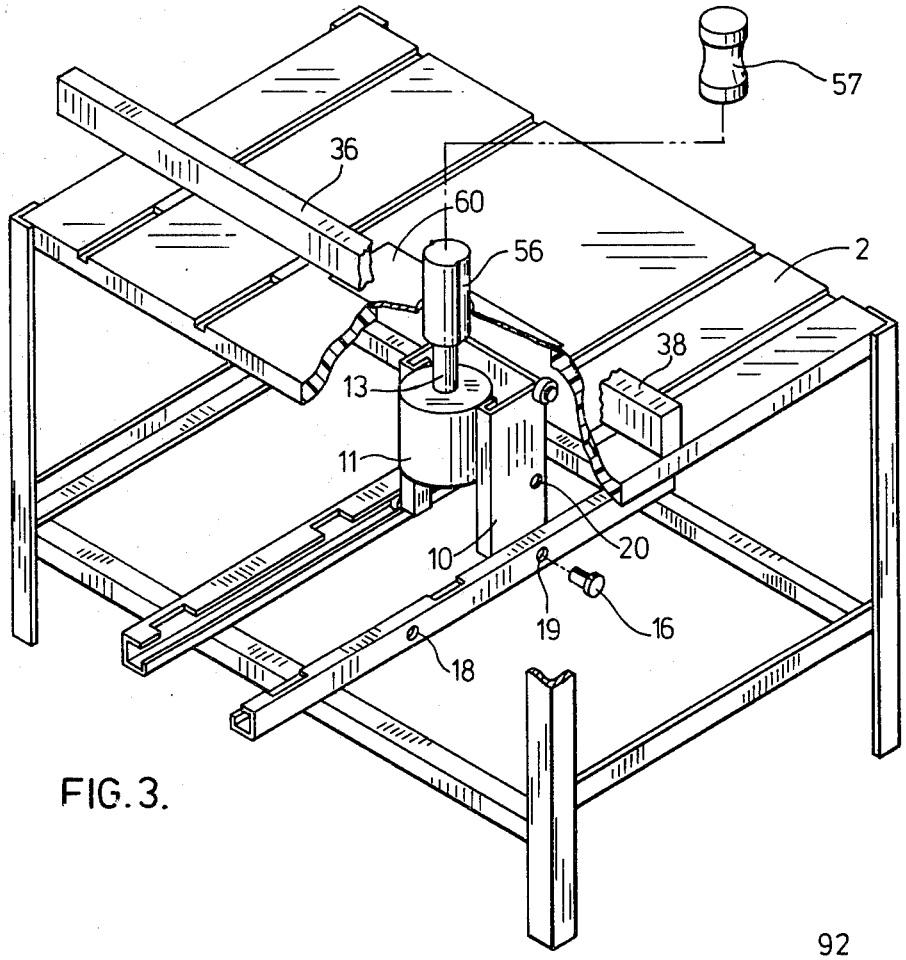
FIG. 3 is a partially cut away perspective view looking down on a preferred arrangement of the woodworking structure of the present invention when used as a planar.

Referring to FIG. 3, the woodworking structure also includes a planing tool 56 which is secured to output shaft 13 of motor 11. Additionally provided, is a plate member 60 designed for use with the planing tool. Guide member 38 is aligned with the outside edge of the planing tool while movable guide member 36 permits a desired amount of material to be planed by the tool. During the planing operation, wood is guided along member 36 to tool 56 and supported beyond the tool by guide 38.

The structure is also useful as a shaping tool with the motor fixed in the vertical position. In order to perform the shaping operation, planing tool 56 is merely replaced with shaping head 57 and guide members 36 and 38 are removed from the working area so that they do not intefere with the shaping operation.

Figure 4:
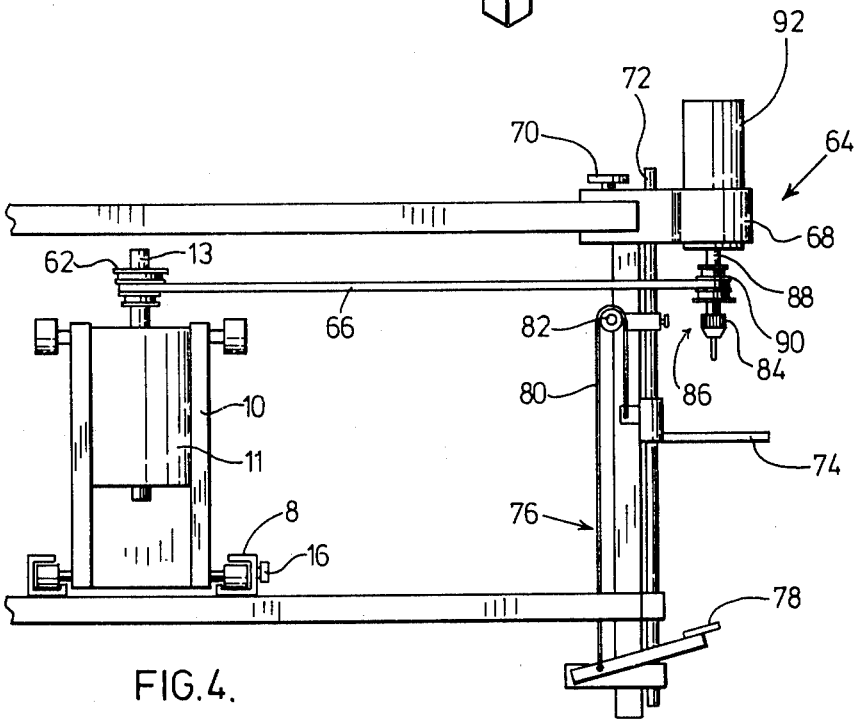
FIG. 4 is a partial side view of a preferred arrangement of the structure according to this invention when used with a drill attachment.

As can be seen in FIG. 4, the vertical positioning of the motor also permits its use for drilling operations. The motor shaft is provided with a variable diameter speed pulley 62 and a specially designed drill press assembly 64 is provided at one end of the table connected to pulley 62 by belt 66. The drill assembly comprises adjustable plate 68 provided with a pair of slots for adjusting the position of the drill components relative to shaft 13 and for tensioning belt 66, bolt means 70 adapted to secure the adjustment plate to the work surface, a vertical shaft 72 providing a guide for moving horizontal platform 74 in the vertical direction, and a positioning assembly generally indicated at 76 for positioning the horizontal platform 74. The positioning assembly comprises a footpress 78, belt 80, and a pulley wheel 82.

The positioning assembly is operated by stepping on footpress 78, which raises platform 74 along shaft 72 to the actual drilling unit. This unit comprises a drill shaft 88 connected to the motor through belt 66 and pulley 90. Drill bit 86 is secured to the drill shaft 88 by a drill chuck 84. The drill shaft 88 is rotatably secured in block 92 rigidly secured with in the adjustment means 68. As can be seen, the arrangement is very easily put into practice and does not require any complicated gearing arrangements, because both the motor and the drill unit remain stationary while the drill platform is raised and lowered with respect to the drill bit to perform the drilling operation.

FIGS. 5 and 6 show a sanding attachment and the use of a sanding belt respectively. The sanding belt is operated by means of a sanding attachment 100 which is used in conjunction with the drill unit so that both the sanding and the drilling operations can be performed simultaneously. Referring to FIG. 5, drill shaft 88 is exposed and recessed in the upper end of drill housing 92, which does not rotate with the drill shaft. The drill shaft is provided on its upper exposed end with slot 102. Cup member 104 provided with tooth-like projection 108 is adapted to fit over the drill housing with the slot 102 engaging tooth 108 to rotatably drive the cup. Sanding belt 109 is fitted over the cup and the drill unit is adjusted by plate 68 to tension belt 109. Ring bearing 106 is provided to allow unrestricted rotation of the cup member on the drill housing. When the motor is activated, shaft 88 is rotated thereby rotating the cup member to drive the sanding belt. As shown in FIG. 6, a second belt support member 110 is provided on the opposite end of the work table from cup 104 and freely rotates with the belt. Member 110 can be secured to the table surface in any suitable manner.

In order to provide a rigid sanding surface, the sanding belt is fitted over members 36 or 38. Guide member 36 is longitudinally extendable to essentially fill the interior confines of the sanding belt.

As will be appreciated from the discussion above, the present invention provides an extremely efficient, inexpensive woodworking unit permitting the user to perform all of the essentially basic woodworking operations without requiring complicated and awkward to use gearing arrangements and a plurality of individual drive motors. Furthermore, the rotatable and slidable aspect of the single motor permits appropriate positioning of the motor beneath a single work area, thereby minimizing the size of the unit and making it particularly useful for amateur home use. The mounting of the motor on bearings or wheels assures ease of rotating and sliding of the motor without requiring and significant strength on the part of the operator.

Although various preferred embodiments of the invention have been described herein in detail, it will be appreciated by those skilled in the art that variations may be made thereto without departing from the spirit of the invention or the scope of the appended claims.

What I claim is :

1. A multiple purpose woodworking table having a single motor for performing a plurality of different woodworking operations and having a table surface with a single working area where said plurality of different woodworking operations are performed, said motor being located below the table surface and being rotatable from a locked horizontal position to a locked vertical position and vice-versa, said motor having an output shaft which when said motor is rotated, is moved away from said single working area, a motor mount supporting said motor, a first set of wheels at one side of said motor mount, a second set of wheels at another side of said motor mount and a third set of wheels at the corners joining the sides, a pair of opposing channel members for rollingly securing said sets of wheels, said channel members including spaced cut-out portions positioned to permit releasing of said first set of wheels from said channel members while fitting said second set of wheels into said channel members and vice versa as said motor and its mount are rotated, said channel members providing a runway for said sets of wheels when fitted therein; and locking means for securing said motor and mount in both the horizontal and vertical working position.

2. A multiple purpose woodworking table as claimed in claim 1, including a saw blade for use with the motor in the horizontal position and a shaping tool and a planing tool for use when in the vertical position.

3. A multiple purpose woodworking table as claimed in claim 1, including a drilling apparatus, including a rotary drill unit, a vertically moveable drill platform and a foot operated positioning arrangement for moving and positioning said drill platform, said rotary drill unit being connected to said output shaft by an endless belt with said motor in the vertical position, said drilling apparatus being adjustably mounted at one end of said table for tensioning of said belt.

4. A multiple purpose woodworking table as claimed in claim 3, including a cup attachment adapted to fit over and rotate with said drill unit, a freely rotatable bearing member at the other end of the table from said drilling apparatus, a sanding belt for tensioning around said cup attachment and bearing member, and a longitudinally extendable guide essentially filling the interior confines of said sanding belt.

5. A multiple woodworking apparatus as claimed in claim 2, including a two piece adjustable guide for use with said saw blade and said planing tool.

* * * * *